US005561490A

United States Patent [19]

Glover et al.

[11] Patent Number: 5,561,490

[45] Date of Patent: Oct. 1, 1996

[54] PHOTOGRAPHIC PROCESSING APPARATUS

[75] Inventors: Edward C. T. S. Glover, London; Anthony Earle, Middlesex, both of United Kingdom

[73] Assignee: Eastman Kodak Company, Rochester, N.Y.

[21] Appl. No.: 518,772

[22] Filed: Aug. 24, 1995

[30] Foreign Application Priority Data

Aug. 27, 1994 [GB] United Kingdom ..... 9417320

[51] Int. Cl.[6] ..... G03D 3/02; G03D 3/08

[52] U.S. Cl. ..... 396/622; 396/630

[58] Field of Search ..... 354/322–324, 354/321, 320, 319; 430/30, 398–400; 134/64 P, 64 R, 122 P, 122 R

[56] References Cited

U.S. PATENT DOCUMENTS

| | | | |
|---|---|---|---|
| 1,996,768 | 4/1935 | Ingman | 354/321 |
| 2,689,729 | 9/1954 | Debrie | 354/321 |
| 3,575,101 | 4/1971 | Eastleigh et al. | 354/324 |
| 5,108,878 | 4/1992 | Nakamura | 354/322 X |
| 5,168,296 | 12/1992 | Nakamura et al. | 354/324 X |
| 5,341,189 | 8/1994 | Helfer et al. | 354/324 |
| 5,353,084 | 10/1994 | Twist et al. | 354/321 |
| 5,379,087 | 1/1995 | Devaney et al. | 354/331 |
| 5,414,484 | 5/1995 | Hofmuth et al. | 354/324 X |

FOREIGN PATENT DOCUMENTS

| | | |
|---|---|---|
| 0562401 | 9/1993 | European Pat. Off. . |
| 0532558 | 9/1994 | European Pat. Off. . |
| 0515454 | 3/1995 | European Pat. Off. . |
| 1050609 | 1/1954 | France . |
| 92/07302 | 4/1992 | WIPO . |
| 93/00612 | 1/1993 | WIPO . |
| 93/11464 | 6/1993 | WIPO . |

*Primary Examiner*—D. Rutledge
*Attorney, Agent, or Firm*—Frank Pincelli

[57] ABSTRACT

It is well known to process photographic materials in web and sheet form by passing the material through a photographic processor which comprises a plurality of processing stages. The material being processed is substantially immersed in the solution in each of the processing stages which results in the use of large volumes of processing solutions. Described herein is a multi-tank processing bath which utilizes low volumes of processing solution and in which the rate of flow of processing solution through the multi-tank processing bath is matched with the transport speed of the material being processed so that the processing solution effectively travels with the portion of the material being processed which it encounters when first introduced into the processing bath. This means that the processing solution is fully exhausted by the time it reaches the end of the processing bath and can be discarded. This ensures that each part of the material being processed has new processing solution.

9 Claims, 2 Drawing Sheets

PHOTOGRAPHIC PROCESSING APPARATUS

FIELD OF THE INVENTION

The present invention relates to photographic processing apparatus and is more particularly concerned with such apparatus comprising multi-tank processing stages.

BACKGROUND OF THE INVENTION

It is well known to process photographic materials in web and sheet form by passing the material through a photographic processor which comprises a plurality of processing stages, for example, developer, bleach, bleach-fix, wash, and stabilizer stages etc. The material is processed in each stage by the processing solutions retained in that particular stage of the processor. In such apparatus, the material being processed is substantially immersed in the solution in each of the processing stages. As a result, the volumes of processing solutions used tend to be large, at least 40 or 50 liters.

It is also known to process photographic materials using low volumes of solution, typically less than 1 liter and around 100 ml. Such arrangements are described in published European patent applications EP-A-0 515 454, EP-A-0 532 558, EP-A-0 546 136, EP-A-0 553 172, EP-A-0 614 545 and others. In processing apparatus in which low volumes of processing solutions are utilized, unstable processing chemistry can be employed, for example, redox amplification (RX) chemistry, where the chemicals can be fully used up before they start to deteriorate affecting processing performance.

EP-A-0 562 401 discloses an arrangement for a photographic processor in which the volumes of processing solution utilized are reduced. The processor is of conventional size, that is, having large tank volumes, but in which lower volumes of processing solutions are utilized. The processing bath for each processing stage comprises a plurality of processing tanks. Each processing bath contains upper and lower guide rollers over which the photographic material to be processed is transported, each of the lower rollers being located in a respective one of the processing tanks. The material is alternately dipped into a processing tank and processing solution retained therein in the bath and not dipped so that the time for which the material is dipped in processing solution is not more than 50% of the total time in that particular processing bath.

PROBLEM TO BE SOLVED BY THE INVENTION

In the apparatus described above, processing solutions are retained in their respective processing tanks and are normally used to process more than one web or sheet of material. This means that sensitometric process control is required to keep the process in balance and to ensure good quality and constant color balance where appropriate.

SUMMARY OF THE INVENTION

It is therefore an object of the present invention to provide photographic processing apparatus which utilizes new chemistry every time new photographic material is to be processed and as a result does not require sensitometric controls as discussed above.

In accordance with one aspect of the present invention, there is provided a method of processing photographic material in a multi-tank process, the method comprising the steps of:

introducing the photographic material into a first tank of the process;

supplying processing solution to the first tank of the process;

allowing processing solution in the first tank to pass into the next and subsequent processing tanks; and transporting the material through each tank of the process;

the method being characterized in that the processing solution flows through the multi-tank process at a rate which matches the rate at which the material being processed is transported through the multi-tank process.

In accordance with another aspect of the present invention, there is provided photographic processing apparatus for processing photographic material, the apparatus comprising:

at least one process comprising a plurality of processing tanks;

processing solution supply means for supplying processing solution to the process; and transport means for transporting the photographic material through the process during processing;

characterized in that the processing solution supply means supplies processing solution to the process at a rate which matches the rate at which the material being processed is transported through the process.

ADVANTAGEOUS EFFECT OF THE INVENTION

In accordance with the method according to the present invention, by matching the rate of flow of processing solution through the multi-tank processing bath with the transport speed of the material being processed, the processing solution effectively travels with the portion of the material being processed which it encounters when first introduced into the processing bath. This means that the processing solution is fully exhausted by the time it reaches the end of the processing bath and can be discarded. This ensures that each part of the material being processed has new processing solution.

BRIEF DESCRIPTION OF THE DRAWINGS

For a better understanding of the present invention, reference will now be made, by way of example only, to the accompanying drawings in which.

DETAILED DESCRIPTION OF THE INVENTION

The present invention relates to a multi-bath photographic processor which utilizes containers of low volume. The processor comprises a plurality of baths, one for each treatment stage of the photographic process. The containers in each bath are connected together to allow the processing solution to flow in the same direction as the direction of travel of the material being processed through the processor.

A pump is utilized to pump the processing solution through the treatment stage at a rate which allows fresh processing solution introduced in the first container of the bath to be associated with a portion of the material arriving in the first container, this solution being pumped through the treatment stage at a rate which matches the transport speed of the material being processed as it passes through each processing bath so that the solution is fully exhausted as it leaves the last container in the bath and is put to waste. As the processing solution treating the material is always fresh, sensitometric process control is not required.

Figure 1:
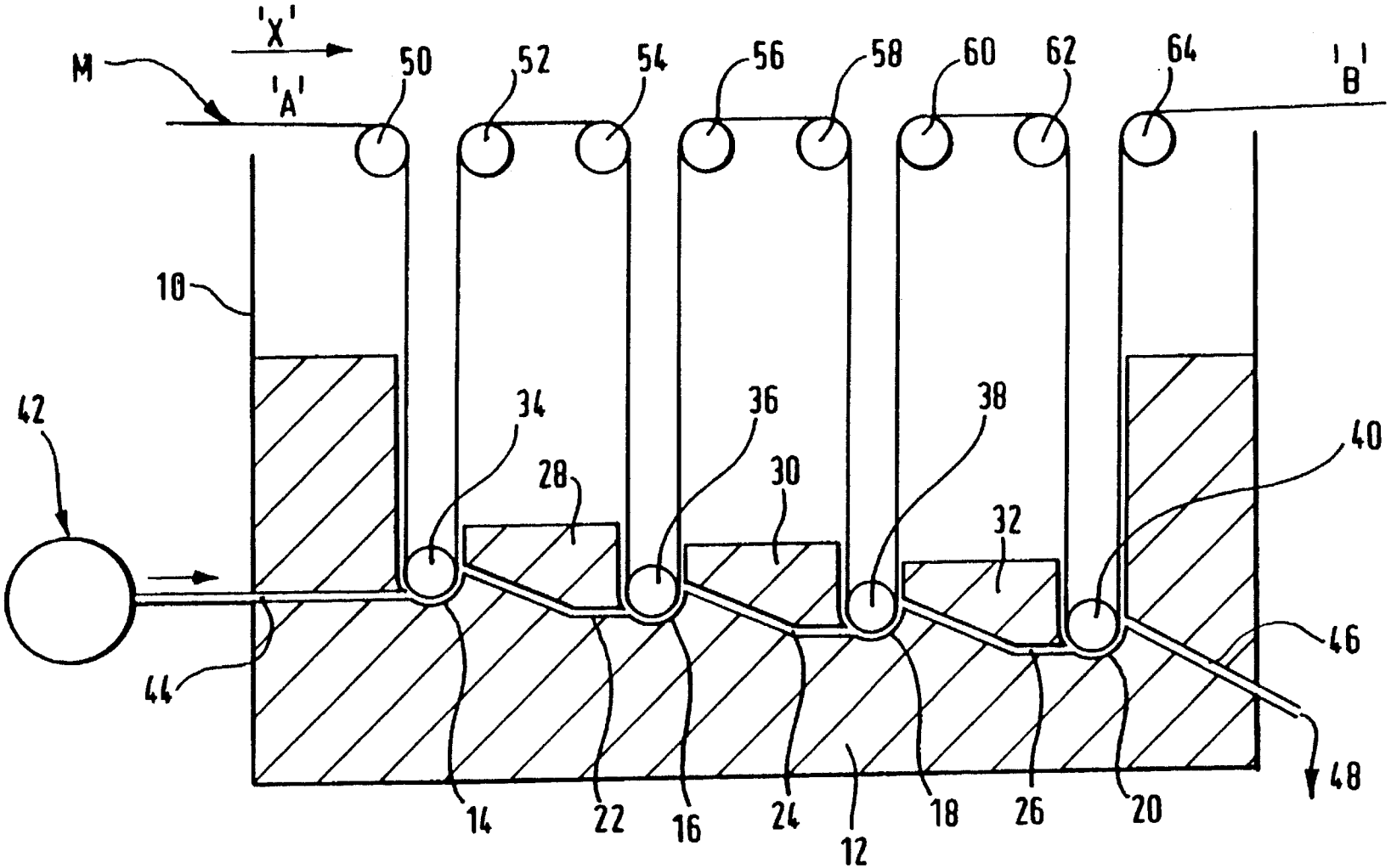
FIG. 1 is a schematic sectioned side elevation of one embodiment of a processing bath in accordance with the present invention.

In FIG. 1, a processing bath 10 is shown. The bath 10 comprises a block 12 in which four low volume processing tanks 14, 16, 18, 20 are formed. Each tank 14, 16, 18, 20 is connected to an adjacent tank by respective ducts 22, 24, 26. The ducts 22, 24, 26 are formed in block 12 and have their upper surfaces defined by respective block portions 28, 30, 32 of block 12. The ducts 22, 24, 26 are around 15 mm deep and could extend the full width of the material to be processed so that no resistance is given to the flow of processing solution therethrough.

Each processing tank 14, 16, 18, 20 has a respective roller 34, 36, 38, 40 associated therewith as shown. Rollers 34, 36, 38, 40 further reduce the volume of the processing tanks 14, 16, 18, 20 and guide the material being processed through the processing bath 10.

Processing solution, for example, developer solution, is pumped into processing tank 14 by pump 42 through duct 44 from a reservoir (not shown). The processing solution is then pumped from tank 14 and into tank 16 through duct 22, from tank 16 into tank 18 through duct 24, from tank 18 into tank 20 through duct 26, and from tank 20 through duct 46 to drain 48. Ducts 44, 46 are formed in block 12 in a similar way to ducts 22, 24, 26. As shown, the processing tanks 14, 16, 18, 20 and ducts 22, 24, 26, 46 are arranged so that processing solution overflows from one processing tank to the next and then to drain 48 at a typical flow rate of 10 $ml/ft^{-2}$.

Further rollers 50, 52, 54, 56, 58, 60, 62, 64 are provided in the upper region of the bath 10 for guiding the material to be processed through the bath 10. Material to be processed, indicated by a solid line and labeled M, is guided from inlet 'A', down into processing tank 14, up out of tank 14 and across and down into tank 16, up out of tank 16 and across and down into tank 18, up out of tank 18 and across and down into tank 20, and up out of tank 20 and on to outlet 'B'.

In accordance with the present invention, material M to be processed travels through the bath 10 in the direction indicated by arrow 'X'. As described above, the processing solution also travels in the same general direction indicated by arrow 'X'. Fresh processing solution is delivered to tank 14 by pump 42 at a rate which is determined by the type of material being processed, the type of chemistry being used in that particular bath and the transport speed of the material through the processor (not shown). In this way, fresh processing solution is introduced into processing tank 14 as the material M arrives at that processing tank and this solution then travels through the processing tank 14 with the material M and then on to the other processing tanks 16, 18, 20 in the bath 10, the solution passing through ducts 22, 24, 26 and the material M passing round rollers 52, 54, 36, 56, 58, 38, 60, 62, 40.

Pump 42 operates so that processing solution which has processed a portion of the material M in tank 14 is pumped through duct 22 to tank 16 as that same portion of the material M arrives in tank 16 after passing up from tank 14 over rollers 52, 54 and down into tank 16. This is repeated for the remaining processing tanks 18, 20 and the used processing solution is then passed to drain 48.

In the apparatus shown in FIG. 1, the material M is a single strand web which travels in one plane only at any one time through the bath 10, that is, the material travels down, up and across the rollers 34, 36, 38, 50, 52, 54, 56, 58, 60, 62, 64 in the bath 10. Naturally, the principle of the present invention can be extended to processing of a multi-strand web. Single processing tanks similar to 14, 16, 18, 20 but extending to accommodate more than one strand of material can still be utilized for processing the multiple strands. However, if the processor is not being run to its capacity, for example, only three strands are being processed on a processor which takes six strands, the processing solution will not be used efficiently and will be sent to drain without being fully exhausted. It is therefore preferable that each strand of a multi-strand web has its own set of processing tanks arranged in a similar way to that shown in FIG. 1 so that efficient use of the processing solutions is made even when the processor is not running at full capacity.

Figure 2:
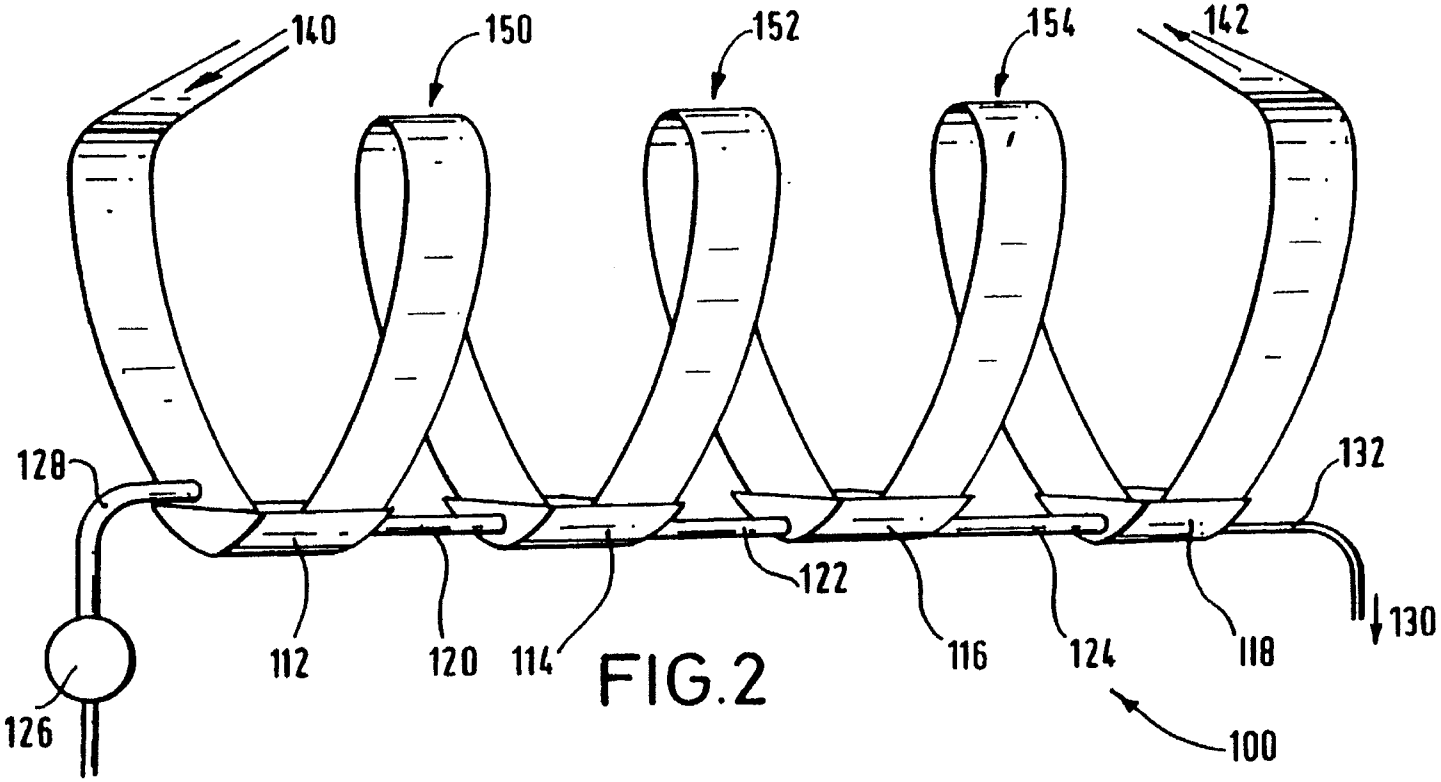
FIG. 2 is a schematic view of a second embodiment of a processing bath in accordance with the present invention.

FIG. 2 is a schematic illustration of another arrangement of processing apparatus in accordance with the present invention. Here, a bath 100 which comprises four processing tanks 112, 114, 116, 118 connected together by pipes 120, 122, 124. Tank 112 is connected to a reservoir (not shown) via a pump 126 and a pipe 128. Tank 118 is connected to drain 130 via pipe 132. In a similar way to that described above, processing solution is pumped into tank 112 and caused to overflow through pipe 120 into tank 114, etc., as material M' is being processed. In this arrangement, the pipes 120, 122, 124 are arranged to enter the next processing tank 114, 116, 118 at different levels so that the processing solution can readily overflow from one processing tank to the next. As described above, the pump 126 pumps in fresh processing solution at a rate to ensure that for any discrete point on the material, the processing chemistry follows that point through the bath.

In FIG. 2, the material M' being processed travels a helical path across and through the bath 100. The material M' enters the bath 100 at inlet 140 and leaves at outlet 142. Rollers (not shown) are positioned in each of the processing tanks 112, 114, 116, 118 and at upper portions 150, 152, 154 of the material M' to guide and drive the material M' through the bath 100. In the next processing bath (not shown), the material M' follows a helical path across and through the bath, but the helix is opposite to that shown in FIG. 2 so that input and exit webs remain in line.

Figure 3:
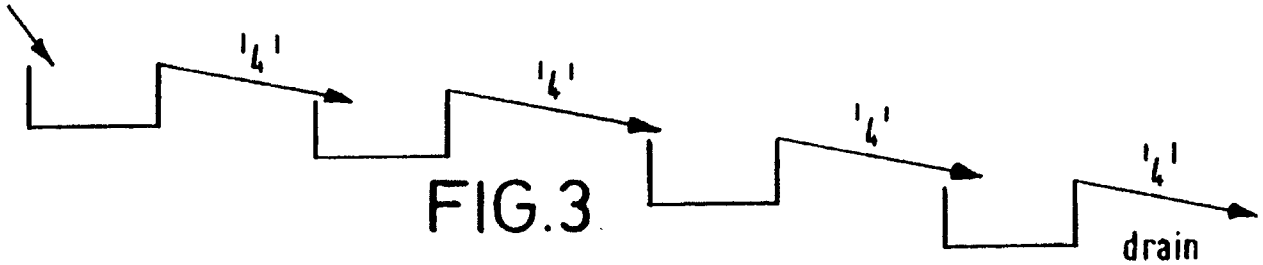
FIG. 3 illustrates an arrangement of processing tanks of a multi-tank processing stage in accordance with the present invention.

Alternatively, processing tanks of a multi-tank processing bath can be arranged so that each tank is at a higher level than a subsequent tank as shown in FIG. 3. Naturally, means are provided (not shown) to allow the processing solution to flow from one tank to the next in the direction indicated by arrows 'Y'. This provides a natural weir between adjacent processing tanks.

It is possible to set up the flow of processing solution in each processing tank to follow the path of the material overflowing from one tank to the next but with the flow of processing solution in the tank being transverse to the plane of the material being processed.

It is to be noted that the present invention is not limited to the particular type of processing apparatus described with reference to FIGS. 1 to 3. The present invention is equally useful in any photographic processor which includes multi-tank processing where the rate of flow of processing solution through a particular process can be matched to the transport speed of the material being processed.

In particular, a processor may comprise a plurality of low volume tanks similar to those shown in, and described with reference to, FIG. 1 with appropriate connections made between groups of tanks containing a particular processing solution, for example, developer, bleach, fix or wash solutions.

Instead of arranging the tanks so that solution passes from one to the next via a weir, as described above, it may be more convenient to utilize a pump for transferring processing solution from one tank to the next.

PARTS LIST

10 . . . processing bath
12 . . . block
14, 16, 18, 20 . . . low volume processing tanks
22, 24, 26 . . . ducts
28, 30, 32 . . . block portions
34, 36, 38, 40 . . . roller
42 . . . pump
44, 46 . . . duct
48 . . . drain
50, 52, 54, 56, 58, 60, 62, 64 . . . rollers
100 . . . bath
112, 114, 116, 118 . . . processing tanks
120, 122, 124 . . . pipes
126 . . . pump
128 . . . pipe
130 . . . drain
132 . . . pipe
140 . . . inlet
142 . . . outlet
150, 152, 154 . . . upper portions

We claim:

1. A method of processing photographic material in a multi-tank process, the method comprising the steps of:

introducing the photographic material into a first tank of the process;

supplying processing solution to the first tank of the process;

allowing processing solution in the first tank to pass into the next and subsequent processing tanks; and transporting the material through the processing solution present in each tank of the process;

the method being characterized in that the processing solution flows through the multi-tank process at a rate which matches the rate at which the material being processed is transported through the multi-tank process such that fresh processing solution supplied to the first tank of the process as photographic material is introduced therein is exhausted as it leaves the last tank of the multi-tank process and can be discarded.

2. A method according to claim 1, wherein the processing solution passes from one processing tank to the next by way of an overflow from the previous tank into the subsequent tank.

3. A method according to claim 1, wherein the processing solution passes from one processing tank to the next by way of a pump.

4. Photographic processing apparatus for processing photographic material, the apparatus comprising:

at least one process comprising a plurality of processing tanks;

processing solution supply means for supplying processing solution to the process; and transport means for transporting the photographic material through the processing solution present in each of the processing tanks during processing;

characterized in that the processing solution supply means supplies processing solution to the process at a rate which matches the rate at which the material being processed is transported through the process such that fresh processing solution supplied to the first tank of the process as photographic material is introduced therein is exhausted as it leaves the last tank of the multi-tank process and can be discarded.

5. Apparatus according to claim 4, wherein one of the plurality of processing tanks is connected to the processing solution supply means, processing solution from the one processing tank being cascaded on to subsequent processing tanks.

6. Apparatus according to claim 4, wherein the processing solution supply means includes a pump for pumping solution through the process at a predetermined rate.

7. Apparatus according to claim 4, wherein each processing tank is at a higher level than a subsequent processing tank.

8. Apparatus according to claim 4, wherein processing solution overflows from one processing tank to the next.

9. Apparatus according to claim 4, wherein processing solution is pumped from one processing tank to the next.

* * * * *